US009377019B1

(12) United States Patent
Blume

(10) Patent No.: US 9,377,019 B1
(45) Date of Patent: Jun. 28, 2016

(54) OPPOSING OFFSET FLUID END BORES

(71) Applicant: George H Blume, Austin, TX (US)

(72) Inventor: George H Blume, Austin, TX (US)

( * ) Notice: Subject to any disclaimer, the term of this patent is extended or adjusted under 35 U.S.C. 154(b) by 256 days.

(21) Appl. No.: 13/887,476

(22) Filed: May 6, 2013

Related U.S. Application Data

(60) Provisional application No. 61/643,541, filed on May 7, 2012.

(51) Int. Cl.
*F04B 53/16* (2006.01)
*F04B 53/00* (2006.01)
*F04B 1/00* (2006.01)

(52) U.S. Cl.
CPC . *F04B 53/16* (2013.01); *F04B 1/00* (2013.01); *F04B 53/00* (2013.01)

(58) Field of Classification Search
CPC ..... F04B 53/16; F04B 1/00; F04B 39/0055; F04B 39/127; F04B 39/122; F04B 39/53; F04B 39/008; F04B 53/00; F04B 27/00; F04B 53/162; F04B 53/008
See application file for complete search history.

(56) References Cited

U.S. PATENT DOCUMENTS

| | | | | |
|---|---|---|---|---|
| 1,947,071 | A | | 2/1934 | Walton |
| 2,236,370 | A | | 3/1941 | Jackman |
| 2,316,480 | A | | 4/1943 | White et al. |
| 2,559,659 | A | | 7/1951 | Redman |
| 2,733,664 | A | | 2/1956 | Saalfrank |
| 2,918,078 | A | | 12/1959 | Cummings |
| 3,053,500 | A | | 9/1962 | Atkinson |
| 3,373,695 | A | * | 3/1968 | Yohpe ..... 417/569 |
| 3,430,575 | A | * | 3/1969 | Roth ..... 417/437 |
| 3,792,939 | A | | 2/1974 | Zalis |
| 3,905,608 | A | | 9/1975 | Olsen |
| 3,907,307 | A | | 9/1975 | Maurer et al. |
| 3,976,402 | A | * | 8/1976 | Lundquist ..... 417/566 |
| 4,084,606 | A | | 4/1978 | Mittleman |
| 4,264,286 | A | * | 4/1981 | Reinkemeyer ..... 417/539 |
| 4,456,440 | A | | 6/1984 | Korner |
| 4,467,703 | A | | 8/1984 | Redwine et al. |
| 4,477,236 | A | | 10/1984 | Elliott |
| 4,508,133 | A | * | 4/1985 | Hamid ..... 137/68.22 |
| 4,527,961 | A | | 7/1985 | Redwine et al. |
| 4,573,886 | A | | 3/1986 | Maasberg et al. |
| 4,766,927 | A | | 8/1988 | Conaster |
| 4,768,933 | A | | 9/1988 | Stachowiak |
| 4,771,801 | A | | 9/1988 | Crump et al. |
| 4,773,833 | A | | 9/1988 | Wilkinson et al. |
| 4,861,241 | A | | 8/1989 | Gamboa et al. |
| 4,878,815 | A | | 11/1989 | Stachowiak |
| 5,020,809 | A | | 6/1991 | Mullaney |
| 5,145,340 | A | | 9/1992 | Allard |
| 5,226,445 | A | | 7/1993 | Surjaatmadja |
| 5,622,486 | A | | 4/1997 | McDuffie et al. |
| 5,839,468 | A | | 11/1998 | Allred |
| 5,924,853 | A | | 7/1999 | Pacht |

(Continued)

*Primary Examiner* — Bryan Lettman
*Assistant Examiner* — Timothy P Solak
(74) *Attorney, Agent, or Firm* — Gary W. Hamilton

(57) ABSTRACT

A plunger pump fluid end housing in which the access, suction, and discharge bores within each fluid chamber are offset from the plunger bores. The plunger bore centerline being fixed by the spacing in the pump power end section. The access, suction, and discharge bores in the outside fluid chambers of the pump are offset toward the center of the fluid end. The direction of the offset of the outside fluid chambers opposes the direction of offset of the opposite outside fluid chambers. A special access bore plug with asymmetrical integral spacers is also disclosed.

6 Claims, 17 Drawing Sheets

(Section Through Plane B of Figure 5)

(56) References Cited

U.S. PATENT DOCUMENTS

| | | | |
|---|---|---|---|
| 6,176,692 | B1 | 1/2001 | Reinartz et al. |
| 6,241,492 | B1 | 6/2001 | Pacht |
| 6,264,441 | B1 | 7/2001 | Marioni |
| 6,267,383 | B1 | 7/2001 | Morvant |
| 6,382,940 | B1 | 5/2002 | Blume |
| 6,517,049 | B2 | 2/2003 | Coppock |
| 6,544,012 | B1 | 4/2003 | Blume |
| 6,623,259 | B1 | 9/2003 | Blume |
| 6,910,871 | B1 | 6/2005 | Blume |
| 7,364,412 | B2 | 4/2008 | Kugelev et al. |
| 7,513,759 | B1 | 4/2009 | Blume |
| 8,894,392 | B1 | 11/2014 | Blume |
| 8,915,722 | B1 | 12/2014 | Blume |
| 2002/0096217 | A1 | 7/2002 | Wu et al. |
| 2008/0041439 | A1 | 2/2008 | Achutharaman et al. |
| 2011/0206546 | A1 | 8/2011 | Vicars |

* cited by examiner (Section Through Plane A of Figure 5)

(Section Through Plane B of Figure 5)

(Section Through Plane C of Figure 5)

(Section B-B of Figure 7A)

(Section C-C of Figure 7A)

(Section D-D of Figure 7A)

(Section B-B of Figure 8A)

(Fluid End Side View)

(Section C-C of Figure 8A)

(Section B-B of Figure 9A)

(Section C-C of Figure 9A)

(Section B-B of Figure 10A)

(Section C-C of Figure 10A)

(Bottom View of Figure 10A)

(Section C-C of Figure 11A)

(Section B-B of Figure 11A)

OPPOSING OFFSET FLUID END BORES

PRIORITY CLAIM AND DATA CORRESPONDING TO RELATED U.S. PATENT APPLICATIONS AND ISSUED PATENTS

This patent application claims priority to Provisional Patent Application Ser. No. 61/643,541, filed on May 7, 2012, which by this reference is incorporated herein for all purposes.

This patent application also is a continuation-in-part of application Ser. No. 13/385,960 filed on Mar. 16, 2012 (now U.S. Pat. No. 8,915,722); application Ser. No. 13/385,960 was a continuation-in-part of application Ser. No. 12/390,517 (now U.S. Pat. No. 8,147,227) filed on Feb. 23, 2009; application Ser. No. 12/390,517 was a continuation-in-part of application Ser. No. 11/125,282 (now U.S. Pat. No. 7,513,759) filed on May 9, 2005; application Ser. No. 11/125,282 was a continuation-in-part of application Ser. No. 10/613,295 (now U.S. Pat. No. 6,910,871) filed on Jul. 3, 2003; application Ser. No. 10/613,295 was a continuation-in-part of application Ser. No. 10/288,706 (now U.S. Pat. No. 6,623,259) filed on Nov. 6, 2002; application Ser. No. 10/288,706 was a continuation-in-part of application Ser. No. 10/139,770 (now U.S. Pat. No. 6,544,012) filed on May 6, 2002; application Ser. No. 10/139,770 was a continuation-in-part of application Ser. No. 09/618,693 (now U.S. Pat. No. 6,382,940) filed on Jul. 18, 2000;

This patent application also is a continuation-in-part of application Ser. No. 13/154,464 filed on Jun. 7, 2011; application Ser. No. 13/154,464 was a continuation-in-part of application Ser. No. 11/927,704 (now abandoned), which was a continuation-in-part of application Ser. No. 10/741,488, and was filed on Oct. 30, 2007 (later abandoned); application Ser. No. 10/741,488 was a continuation-in-part of application Ser. No. 10/662,578, and was filed on Dec. 19, 2003 (later abandoned); application Ser. No. 10/662,578 was a continuation-in-part of application Ser. No. 10/288,706 (now U.S. Pat. No. 6,623,259) filed on Nov. 6, 2002; application Ser. No. 10/288,706 was a continuation-in-part of application Ser. No. 10/139,770 (now U.S. Pat. No. 6,544,012) filed on May 6, 2002; application Ser. No. 10/139,770 was a continuation-in-part of application Ser. No. 09/618,693 (now U.S. Pat. No. 6,382,940) filed on Jul. 18, 2000.

Priority is hereby claimed to each of the above-referenced patent applications and the corresponding issued patents. Furthermore, each the patent applications and, issued patents corresponding to said patent applications, are hereby incorporated by reference for all purposes.

FIELD OF THE INVENTION

The invention relates generally to high-pressure plunger pumps used, for example, in oil field operations. More particularly, the invention relates to high-pressure plunger pumps having opposing offset fluid end bores.

BACKGROUND

Engineers typically design high-pressure oil field plunger pumps in two sections; the (proximal) power section and the (distal) fluid section. The power section usually comprises a crankshaft, reduction gears, bearings, connecting rods, crossheads, crosshead extension rods, etc. The power section is commonly referred to as the power end by the users and hereafter in this application. The fluid section is commonly referred to as the fluid end by the users and hereafter in this application. Commonly used fluid sections usually comprise a plunger pump housing having a suction valve in a suction bore, a discharge valve in a discharge bore, an access bore, and a plunger in a plunger bore, plus high-pressure seals, retainers, etc. FIG. 1 is a cross-sectional schematic view of a typical fluid end showing its connection to a power end by stay rods. FIG. 1 also illustrates a fluid chamber which is one internal section of the housing containing the valves, seats, plungers, plunger packing, retainers, covers, and miscellaneous seals previously described. A plurality of fluid chambers similar to that illustrated in FIG. 1 may be combined, as suggested in the Triplex fluid end housing schematically illustrated in FIG. 2. It is common practice for the centerline of the plunger bore and access bore to be collinear. Typically in the prior art, the centerlines of the plunger bore, discharge bore, suction bore, and access bore are all arranged in a common plane. The spacing of the plunger bores, plungers, plunger packing, and plunger gland nut within each fluid chamber is fixed by the spacing of the crank throws and crank bearings on the crankshaft in the power end of the pump.

Valve terminology varies according to the industry (e.g., pipeline or oil field service) in which the valve is used. In some applications, the term "valve" means just the moving element or valve body. In the present application, however, the term "valve" includes other components in addition to the valve body (e.g., various valve guides to control the motion of the valve body, the valve seat, and/or one or more valve springs that tend to hold the valve closed, with the valve body reversibly sealed against the valve seat).

Each individual bore in the plunger pump fluid end housing is subject to fatigue due to alternating high and low pressures which occur with each stroke of the plunger cycle. Conventional plunger pump fluid end housings typically fail due to fatigue cracks in one of the areas defined by the intersecting suction, plunger, access and discharge bores as schematically illustrated in FIG. 3.

To reduce the likelihood of fatigue cracking in the high pressure plunger pump fluid end housings described above, a Y-block fluid end housing design has been proposed. The Y-block design, which is schematically illustrated in FIG. 4A, reduces stress concentrations in a plunger pump housing such as that shown in FIG. 3 by increasing the angles of bore intersections above 90°. In the illustrated example of FIG. 4A, the bore intersection angles are approximately 120°. A more complete cross-sectional view of a Y-block plunger pump fluid end assembly is schematically illustrated in FIG. 4B.

Although several variations of the Y-block design have been evaluated, none have become commercially successful for several reasons. One reason is that mechanics find field maintenance on Y-block fluid ends difficult. For example, replacement of plungers and/or plunger packing is significantly more complicated in Y-block designs than in the earlier designs represented by FIG. 1. In the earlier designs, provision is made to push the plunger distally through the plunger bore and out through an access bore (see, e.g., FIG. 3). This operation, which would leave the plunger packing easily accessible from the proximal end of the plunger bore, is impossible in a Y-block design.

Thus the Y-block configuration, while reducing stress in plunger pump fluid end housings relative to earlier designs, is associated with significant disadvantages. However, new high pressure plunger pump fluid end housings that provide both improved internal access and superior stress reduction are described in U.S. Pat. Nos. 8,147,227, 7,513,759, 9,910,871, 6,623,259, 6,544,012 and 6,382,940, which are incorporated herein by reference. One embodiment of a right angular plunger pump such as that described in U.S. Pat. No. 8,147, 227 (hereinafter the '227 patent) very similar to fluid end of this application schematically illustrated in FIG. 6A. It includes a right-angular plunger pump fluid end housing comprising a suction valve bore (suction bore), discharge valve bore (discharge bore), plunger bore and access bore. The suction and discharge bores each have a portion with substantially circular cross-sections for accommodating, e.g., a valve seat. Note that the illustrated portions of the suction and discharge bores that accommodate a valve seat are slightly conical to facilitate substantially leak-proof and secure placement of each valve seat in the pump fluid end housing (e.g., by press-fitting a valve seat that has an interference fit with the pump housing). Less commonly, the portions of suction and discharge bores intended to accommodate a valve seat are cylindrical instead of being slightly conical. Further, each bore (i.e., suction, discharge, access and plunger bores) comprises a transition area which interfaces with other bore transition areas.

The plunger bore of the right-angular plunger pump fluid end housing of '227 patent similar to FIG. 6A, comprises a plunger bore having a proximal packing area (i.e., an area relatively nearer the power section) and a distal transition area (i.e., an area relatively more distant from the power section). Between the packing and transition areas is a right circular cylindrical area for accommodating a plunger. The transition area of the plunger bore facilitates interfaces with analogous transition areas of other bores as noted above.

Each bore transition area of the right-angular pump fluid end housing of '227 patent similar to FIG. 6A, has a stress-reducing feature comprising an elongated (e.g., elliptical or oblong) cross-section that is substantially perpendicular to each respective bore's longitudinal axis. Intersections of the bore transition areas are chamfered, the chamfers comprising additional stress-reducing features. Further, the long axis of each such elongated cross-section is substantially perpendicular to a plane that contains, or is parallel to, the longitudinal axes of the suction, discharge, access and plunger bores.

An elongated suction bore transition area, as described in the '227 patent, can simplify certain plunger pump fluid end housing structural features needed for installation of a suction valve. Specifically, the valve spring retainer of a suction valve installed in such a fluid end housing does not require a retainer arm projecting from the fluid end housing. Nor do threads have to be cut in the housing to position the retainer that secures the suction valve seat. Benefits arising from the absence of a suction valve spring retainer arm include stress reduction in the plunger pump housing and simplified machining requirements. Further, the absence of threads associated with a suction valve seat retainer in the suction bore eliminates the stress-concentrating effects that would otherwise be associated with such threads.

Threads can be eliminated from the suction bore if the suction valve seat is inserted via the access bore and the suction bore transition area and press-fit into place as described in the '227 patent. Following this, the suction valve body can also be inserted via the access bore and the suction bore transition area. Finally, a valve spring is inserted via the access bore and the suction bore transition area and held in place by a similarly-inserted oblong suction valve spring retainer, an example of which is described in the '227 patent. Note that the '227 patent illustrates an oblong suction valve spring retainer having a guide hole (for a top-stem-guided valve body), as well as an oblong suction valve spring retainer without a guide hole (for a crow-foot-guided valve body).

The '227 patent also shows how discharge valves can be mounted in the fluid end of a high-pressure pump incorporating positive displacement pistons or plungers. For well service applications both suction and discharge valves typically incorporate a traditional full open seat design with each valve body having integral crow-foot guides. This design has been adapted for the high pressures and repetitive impact loading of the valve body and valve seat that are seen in well service. However, stem-guided valves with full open seats could also be considered for well service because they offer better flow characteristics than traditional crow-foot-guided valves. But in a full open seat configuration stem-guided valves may have guide stems on both sides of the valve body (i.e., "top" and "lower" guide stems) or only on one side of the valve body (e.g., as in top stem guided valves) to maintain proper alignment of the valve body with the valve seat during opening and closing. Conventional valve designs incorporating secure placement of guides for both top and lower valve guide stems have been associated with complex components and difficult maintenance.

The '227 application, of which the present application is a continuation-in-part, describes alternative methods and apparatus related to valve stem guide and spring retainer assemblies and to plunger pump fluid end housings in which they are used. Typically, such plunger pump housings incorporate one or more of the stress-relief structural features described herein, plus one or more additional structural features associated with use of alternative valve stem guide and spring retainer assemblies in the housings. Such plunger pump fluid end housings do not comprise an oblong lip for securing a suction valve spring retainer as necessary in previous applications. The absence of this oblong lip simplifies machining of the plunger pump fluid end housing, and the corresponding design results in reduced stress within the pump housing.

Illustrated embodiments in the '227 application of valve stem guide and spring retainer assemblies include, for example, a combination comprising a discharge valve lower stem guide (DVLSG), plus a suction valve top stem guide and spring retainer (SVTSG-SR), plus spacers for spacing the DVLSG a predetermined distance apart from the SVTSG-SR. Alternative embodiments comprise other combinations of structural features such as, for example, spring retainers and spacers with or without associated valve guides. Note that due to the close fit of the DVLSG within the discharge bore and of the SVTSG-SR within the suction bore, insertion or removal of these structures requires maintaining precise alignment as to rotation and angle of entry with their respective bores. Such precise alignment may be difficult to maintain during field service operations.

Applicant's U.S. Pat. No. 8,147,227 discloses further improvements to the DVLSG, spacers, and the SVTSG-SR, referred to as a tapered suction valve top stem guide and spring retainer (SVTSG-SR-II), alternately a suction valve spring retainer (SVSR), as well as a tapered discharge valve lower stem guide (DVLSG-II), tapered discharge bore spacer (TDBS). The SVSR is for use with more conventional valves with crow foot valve guides as shown in FIG. 1.

Applicant's U.S. Pat. No. 7,186,097 discloses an offset access bore; with the offset in the direction toward the suction bore, perpendicular to the plane formed by the multiple axes of the plunger bores.

Manufacture of fluid end housings can be very expensive due to the very large steel forging that must be procured from which the fluid end housings are machined. Because of the large size of the fluid end, typically this housing is machined from an open die forging. By definition, open die forgings are made without dies and can be produced in only rectangular prism or block shapes. While a near net shape of the raw material used in the manufacture of the housing can be achieved with a casting, castings have poor elongation properties compared with forgings. Plastic elongation of forged fluid end steel material is 10% or greater. While the plastic elongation of similar material in a cast condition approaches 0%. A minimum plastic elongation of 10% is required for high pressure cyclic fatigue resistance.

Oilfield plunger pumps are typically truck mounted and, therefore, overall weight is very important for the operation on the trucks. These trucks typically operate near US Government road weight limits. A smaller housing will reduce the weight of the fluid end and the raw material costs of the block forging from which the fluid end housing is machined. Because forgings in this size are open die, rectangular prisms or blocks, any reduction in the outside dimensions of length, width, and height will result in significant reduction of raw material and finished weight of the fluid end housing.

SUMMARY OF THE INVENTION

In the first embodiment, the fluid end housing comprises first, second, and third plunger bores, wherein the first plunger bore is disposed on a first axis corresponding to a centerline axis of the housing. The second plunger bore is disposed on a second axis parallel to said first axis, and spaced from the first axis by a first predetermined distance defining as the second plunger spacing. The third plunger bore is disposed on a third axis parallel to said first and second axes and spaced from the first axis by a second predetermined distance defining as the third plunger spacing, wherein said second and third plunger spacing is usually but not necessarily equal.

Embodiments are disclosed for an improved fluid end housing comprising opposing offset bores. Various embodiments of the fluid end housing comprise multiple fluid chambers and each such chamber comprising an access bore, a discharge bore, a suction bore, and a plunger bore. The access bore, discharge bore, and suction bore each comprise elongated cylindrical cross-sections. In various embodiments, access bore, discharge bore, and suction bore each are offset longitudinally from the plunger bore in a direction perpendicular to a plane formed by the axes of the access bore, discharge bore, and suction bore.

In yet another embodiment, the respective axes of the access bore, discharge bore, and suction bores of the internal fluid chambers are not offset with respect to the axis of the plunger bore. In some embodiments, the plunger bore pierces the elongated cylindrical section of the access bore.

Embodiments are disclosed for an improved fluid end housing comprising opposing offset bores. Various embodiments of the fluid end housing comprise multiple fluid chambers and each such chamber comprising an access bore, a discharge bore, a suction bore, and a plunger bore wherein the access, discharge and suction bores are offset in a direction toward the center of the fluid end housing. When the said bores are offset toward the center, the overall width and weight of the fluid end housing can be reduced by an amount appropriate to the amount of the offset.

Alternative embodiments of the present invention are disclosed below with reference to appropriate drawings.

DETAILED DESCRIPTION OF PREFERRED EMBODIMENTS

Figure 1:
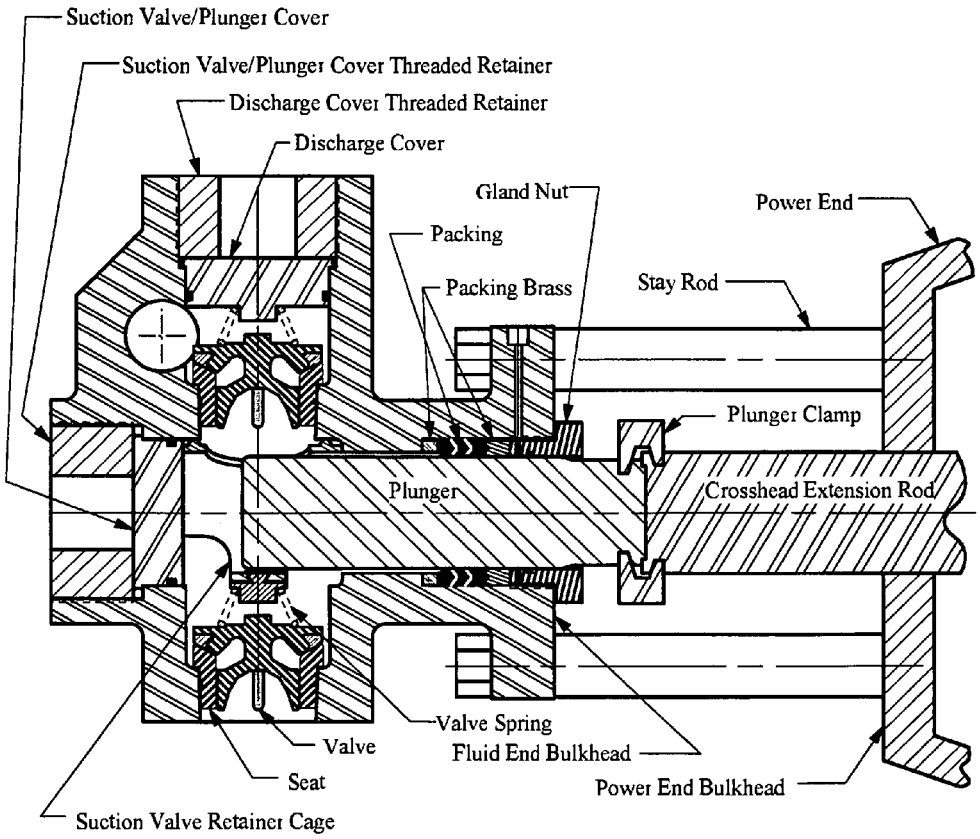
Prior Art Figure 1
FIG. 1 is a cross-sectional schematic view of a typical plunger pump fluid end showing its connection to a power section by stay rods.
Figure 2:
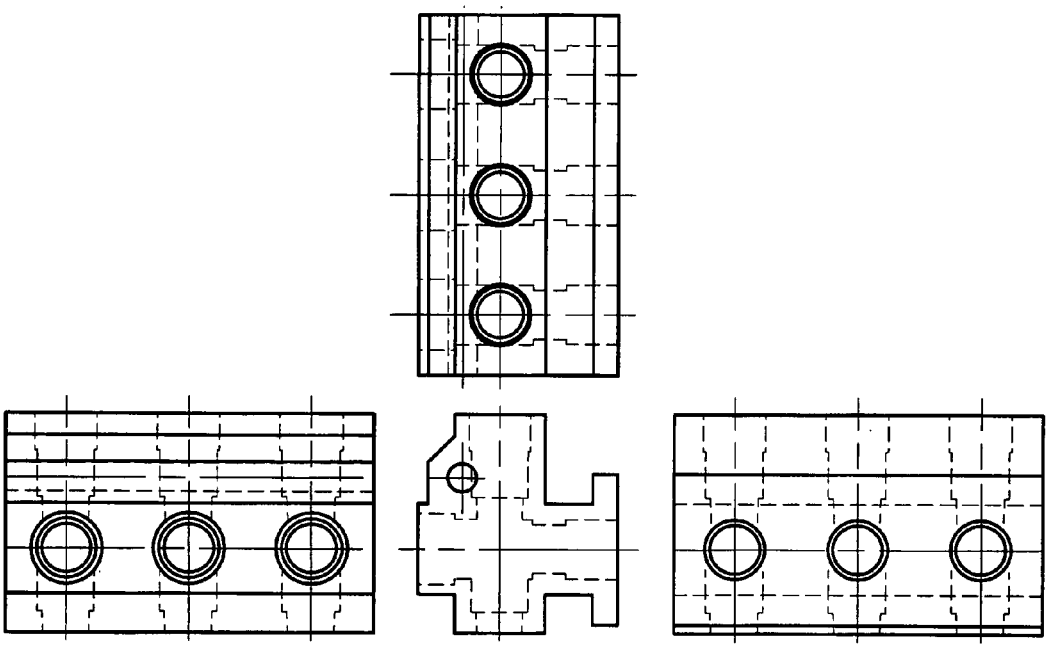
Prior Art Figure 2
FIG. 2 schematically illustrates a conventional Triplex plunger pump fluid end housing.
Figure 3:
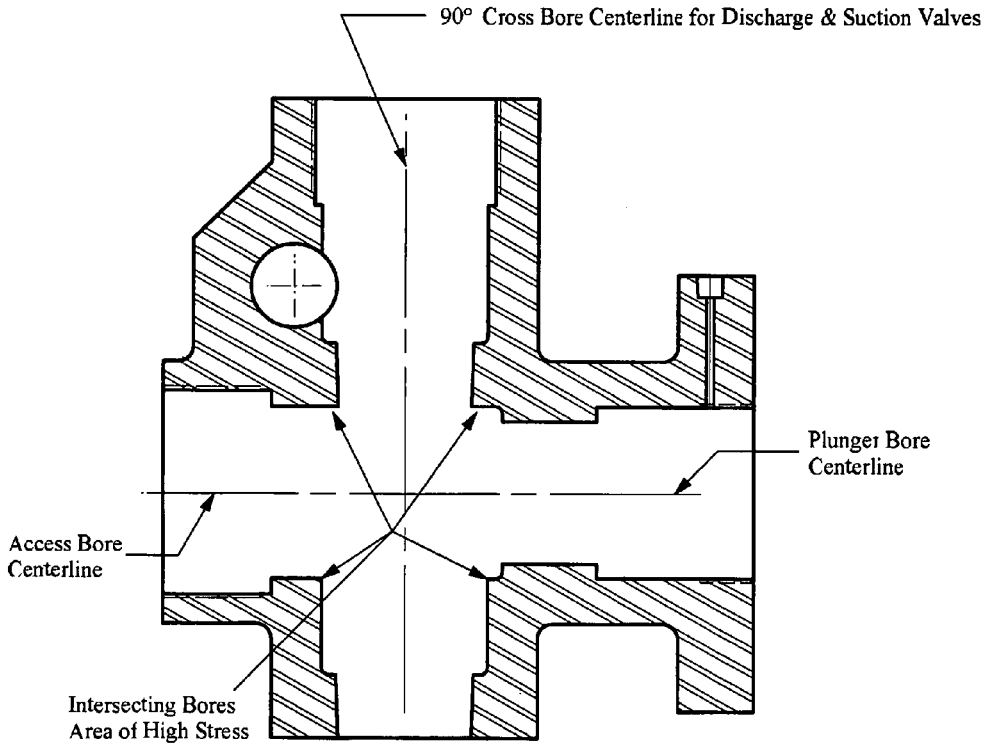
Prior Art Figure 3
FIG. 3 is a cross-sectional schematic view of suction, plunger, access and discharge bores of a conventional plunger pump fluid end housing intersecting at right angles and showing areas of elevated stress.
Figure 4A:
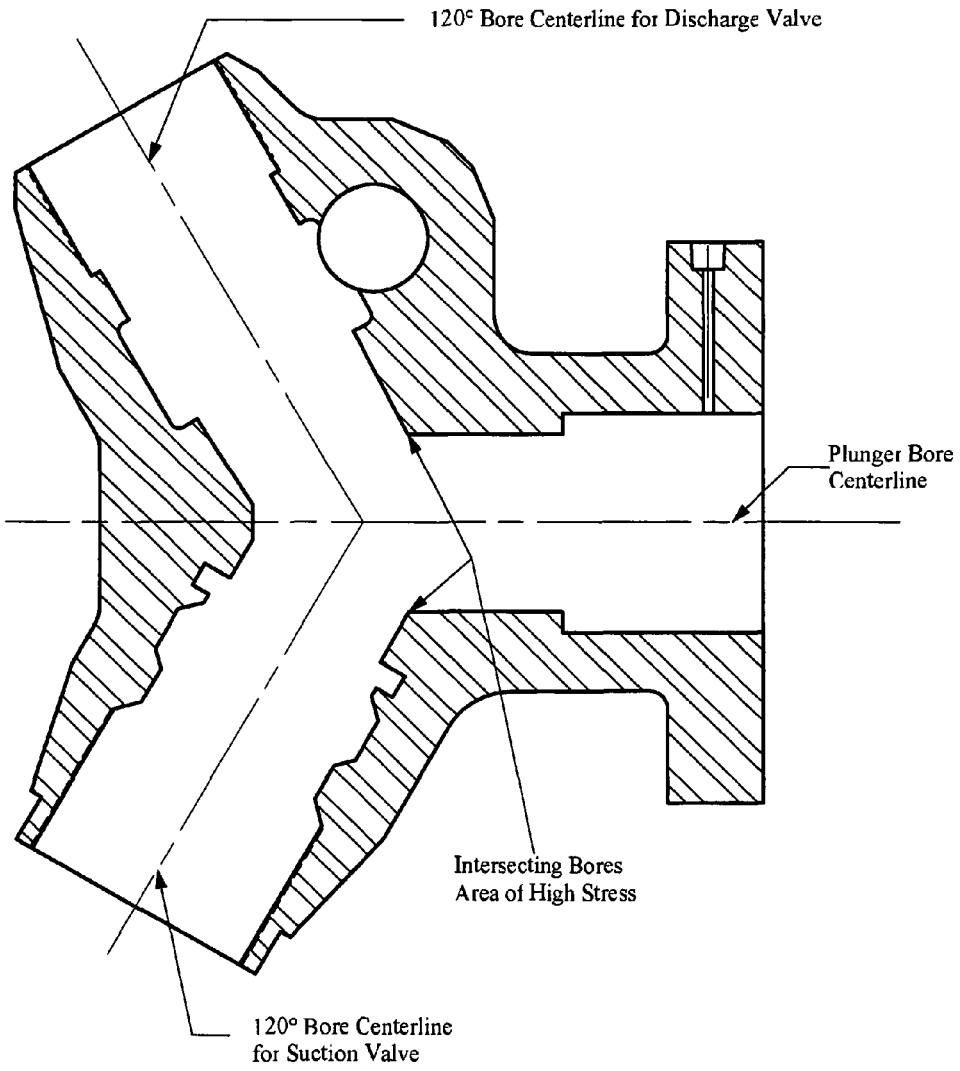
Prior Art Figure 4A
FIG. 4A is a cross-sectional schematic view of suction, plunger and discharge bores of a Y-block plunger pump fluid end housing intersecting at obtuse angles showing areas of elevated stress.
Figure 4B:
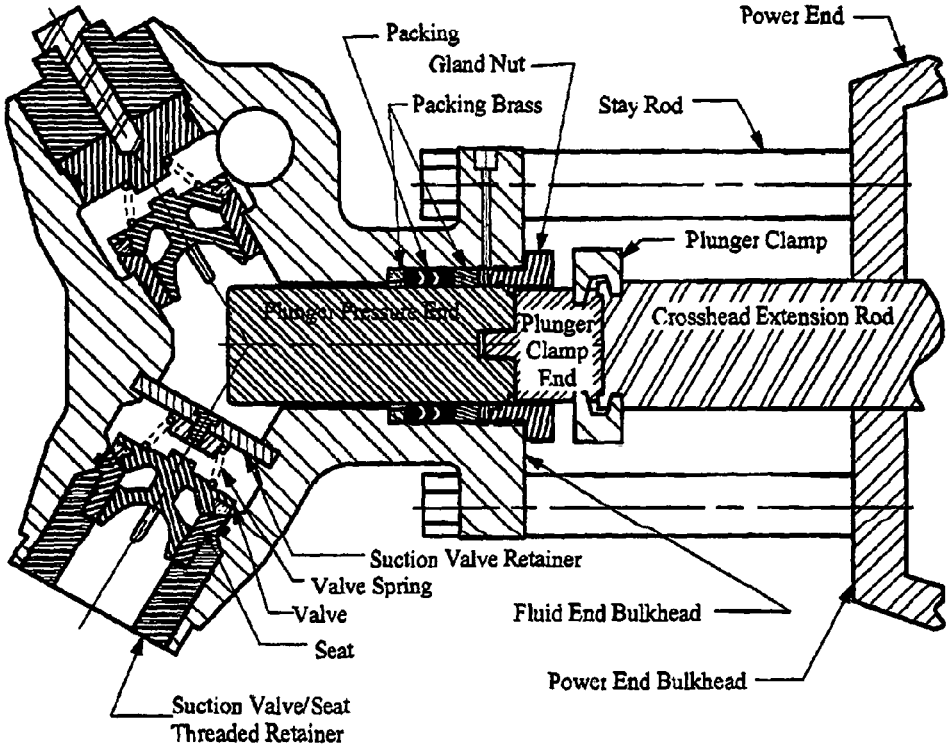
Prior Art Figure 4B
FIG. 4B is a cross-sectional schematic view similar to that in FIG. 4A, including internal plunger pump components of a Y-block fluid end.

Detailed discussion will now be provided for embodiments of a fluid end block utilizing opposing offset bores. The embodiments of the present invention reduce the fluid end weight and reduce manufacturing costs. The present invention also provides for the reconfiguration of the integrated spacers and access bore plug for spacing the DVLSG-II, alternately the TDBS, a predetermined distance apart from the SVTSG-SR-II. Alternately a SVSR can be used with conventional valves in lieu of the SVTSG-SR-II.

The height of the fluid end housing is determined by the valves, seats, and their associated components. The length of the fluid end housing is determined by the pump stroke and plunger. The width, measured in a direction across the plungers is determined by the plunger bore spacing and the wall thickness on the outside of the plunger bores. The plunger bore spacing is fixed by the spacing on the crankshaft in the power end of the pump. Thus the spacing between the plunger bores in the fluid end cannot be changed. The outside wall thickness cannot be changed due to strength requirements to contain the cyclic pressure internal loads in the fluid chambers.

In the prior art, the axes of the suction, discharge, and access bores have always been co-planar with the plunger bore. While the location of the plunger bore is fixed, the engineer has some latitude as to the location of the remaining bores and components within each fluid chamber. The oblong bores disclosed in the applicants previous patents present a unique design opportunity to offset the access, discharge, and suction bores of the fluid end and reduce the overall width of the fluid end without reducing the outside wall thickness of the fluid end. Because the access bore is oblong in cross sectional shape, the plunger bore can be machined to extend into the oblong bore without leaving a discontinuity or mismatch between the two bores. Such mismatches could lead to stress risers that reduce the performance life of the fluid end. Referring to FIGS. 6B and 6C, the amount of offset of the access, discharge, and suction bores from the plunger bores (B-O) is limited by the sum of elongation in elongated cylinders of the access bore (AB-E) plus the difference between the minimum radius of the elongated cylinder in the access bore (AB-R) and the plunger passage bore (PP-R.) When AB-R equals the PP-R, the maximum B-O equals the AB-E. The direction of the offset lies in a plane formed by the axes of the plunger bores and perpendicular to the axis of any of the plunger bores. The direction of the offset of the access, discharge, and suction bores is always towards the center of the fluid end. Thus the access, discharge, and suction bores of the outside fluid chambers offset toward each other in opposing directions. For fluid ends with plungers greater than two, the access, discharge, and suction bores of the remaining central fluid chambers may or may not be offset.

Plunger pump fluid end housings of the present invention comprise substantially right-angular housings having substantially in-line (i.e., opposing) suction and discharge bores. Plunger and access bores of the present invention are coplanar. Present invention also includes high pressure seals, retainers, etc. not otherwise called out. Where indicated as being co-linear and/or co-planar, bore centerlines (or longitudinal axes) may vary somewhat from these precise conditions, due for example to manufacturing tolerances, while still substantially reflecting advantageous structural features of the present invention. The occurrence of such variations in certain manufacturing practices means that plunger pump fluid end housing embodiments of the present invention may vary somewhat from a precise right-angular configuration. Such plunger pump fluid end housings substantially reflect advantageous structural features of the present invention notwithstanding angles between the centerlines or longitudinal axes of adjacent bores that are within a range from approximately 85 degrees to approximately 95 degrees. Where the lines and/or axes forming the sides of such an angle to be measured are not precisely coplanar, the angle measurement is conveniently approximated using projections of the indicated lines and/or axes on a single plane in which the projected angle to be approximated is maximized.

In illustrated plunger pump fluid end housings of the present invention the suction bore transition area is outwardly flared as described above. One illustrated embodiment of a plunger pump housing of the present invention comprises a suction bore comprising a first portion having substantially circular cross-sections and a first centerline for accommodating, e.g., a circular suction valve seat, followed by a second portion having elongated cross-sections. The suction bore second portion comprises in general a cylindrical area having elongated cross-sections followed by an outwardly flared transition area having elongated cross-sections. The cylindrical area may be tapered to accommodate a tapered seat in alternative embodiments, while the outwardly flared transition area has a first predetermined outward taper that facilitates insertion, removal and self-centering of a SVTSG-SR-II. There is a suction bore shoulder between the first and second portions of the suction bore.

One illustrated embodiment of a plunger pump fluid end housing of the present invention also comprises a discharge bore comprising a first portion with substantially circular cross-sections and a second centerline for accommodating, e.g., a circular discharge valve seat, followed by a second portion. A discharge bore shoulder is located between the first and second portions. The discharge bore second portion comprises, in general, a cylindrical area (i.e., an area that is not flared) extending from the discharge bore shoulder and having elongated cross-sections, followed by an outwardly flared transition area having elongated cross-sections. The cylindrical area may be tapered to accommodate a tapered seat in alternative embodiments, while the outwardly flared transition area has a second predetermined outward taper that facilitates insertion, removal and self-centering of a DVLSG-II or a TDBS). Note that the first and second centerlines are co-linear.

Illustrated embodiments of plunger pump fluid end housings of the present invention further comprise an access bore comprising a distal retainer portion with substantially circular cross-sections and a third centerline. The third centerline is usually coplanar with the first and second centerlines. The distal retainer portion accommodates an access bore plug retainer and is followed by a proximal transition area having elongated cross-sections that can be sealed with a removable (flanged or flangeless) access bore plug. An access bore shoulder is located between the distal retainer portion and the proximal transition area. Removal of the access bore plug facilitates access to interior portions of the plunger pump fluid end housing. The access bore proximal transition area may be cylindrical or, in alternative embodiments, it may be inwardly flared (i.e., the proximal transition area may have a first predetermined inward taper extending from the access bore shoulder). Removal and replacement of an access bore plug having a peripheral inward taper corresponding to the first predetermined inward taper of such an access bore transition area is easier than performing these operations with a cylindrical access bore plug in a cylindrical access bore transition area. However, maintenance of precise alignment as to rotation and angle of entry or removal of such a cylindrical access bore plug can still be achieved during routine maintenance because of the relatively exposed location of the access bore plug. Thus, the choice of a cylindrical or tapered configuration for an access bore plug and a corresponding access bore transition area may additionally involve considerations such as the cost of machining these structures.

Each elongated circular cross-section of the access bore is composed of two hemi-cylindrical sections connected by an elongated rectangular section. The hemi-cylindrical sections are defined by a fourth centerline displaced bi-directionally from the third centerline in the direction of the elongations.

All illustrated embodiments of a plunger pump fluid end housing of the present invention comprise a plunger bore comprising a proximal packing area and a distal transition area, the packing area having substantially circular cross-sections and a fifth centerline. An alternative illustrated embodiment of a plunger pump housing of the present invention comprises, in addition to these features, a plunger bore shoulder between the proximal plunger bore packing area and the distal plunger bore transition area.

In the outside fluid chambers, the first, second, third and fourth centerlines are offset in a plane formed by the plunger bore centerlines and in a direction perpendicular to the fifth centerline. The direction of the offset is always towards the center of the fluid end for the outside bores. Thus the outside access, discharge, and suction bores offset toward each other in opposing directions. For fluid ends with plungers greater than two, the access, discharge, and suction bores of the remaining fluid chambers may or may not be offset.

The fifth centerline is coplanar with the third and fourth centerlines. When the first, second, third and fourth centerlines are offset in unison from the fifth centerline, the amount of the offset may equal, but not exceed the displacement of the fourth centerline from the third centerline that forms the elongated section of the oblong access bore. If the previously described offset exceeds the displacement of the fourth centerline, the surface of the oblong access bore would be unintentional disrupted when machined the plunger massage bore. Because of this disruption, the oblong access bore surface would then not be continuous. The seal on the access bore plug or any other high pressure seal cannot seal across a discontinuous surface. An extreme offset of the access bore from the plunger bore would result in unacceptable seal failure in the access bore.

Schematic illustrations of plunger pump fluid end housings of the present invention show that the suction bore transition area and the suction bore cylindrical area (when present) each have at least one elongated cross-section substantially perpendicular to the first centerline and with a long axis substantially perpendicular to a plane containing the first, second, and third centerlines.

Analogously, schematic illustrations of plunger pump fluid end housings of the present invention show that the discharge bore transition area and the discharge bore cylindrical area (when present) each have at least one elongated cross-section substantially perpendicular to the second centerline and with a long axis substantially perpendicular to a plane containing the first, second, and third centerlines.

And the access bore transition area of schematically illustrated plunger pump fluid end housings of the present invention has at least one elongated cross-section substantially perpendicular to the third centerline. Such an elongated cross-section has a long axis substantially perpendicular to a plane containing the first, second, and third centerlines. Note that each said bore transition area has at least one adjacent chamfer for smoothing bore interfaces.

The plunger bore transition area of schematically illustrated plunger pump fluid end housings of the present invention also has at least one elongated cross-section substantially perpendicular to the third centerline. Such an elongated cross-section has a long axis substantially perpendicular to a plane containing the first, second, and third centerlines. The plunger bore transition area is typically and substantially an extension of the access bore transition area.

An illustrated embodiment of a DVLSG-II of the present invention can be placed substantially within a correspondingly outwardly flared discharge bore transition area of a plunger pump fluid end housing of the present invention. The illustrated DVLSG-II comprises a body having a first end, a second end, a longitudinal axis, and at least one elongated cross-section that is perpendicular to the longitudinal axis. The DVLSG-II's body is outwardly flared longitudinally (i.e., the body has a third predetermined peripheral outward taper from the first end to the second end). The DVLSG-II's body additionally comprises at least one peripheral 0-ring groove, a centrally-located lower valve stem guide, and at least one longitudinal fluid passage extending between the first and second ends. The first end of the DVLSG-II body comprises a shoulder mating surface for mating with a corresponding shoulder within the discharge bore, and the second end of the DVLSG-II body comprises at least one discharge lateral alignment lip. An O-ring lies in the O-ring groove.

For applications of the present invention involving a discharge valve body comprising a top guide stem without a lower guide stem, the lower stem guide of the DVLSG-II may be eliminated, thus forming a tapered discharge bore spacer (TDBS). In such applications, a TDBS can be placed substantially within a correspondingly outwardly flared discharge bore transition area of a plunger pump fluid end housing. The TDBS comprises a body having a first end, a second end, a longitudinal axis, and at least one elongated cross-section that is perpendicular to the longitudinal axis. The TDBS's body is outwardly flared longitudinally (i.e., the body has a fourth predetermined peripheral outward taper from the first end to the second end). The TDBS's body additionally comprises at least one peripheral O-ring groove and at least one longitudinal fluid passage extending between the first and second ends. The first end of the TDBS body comprises a shoulder mating surface for mating with a corresponding shoulder within the discharge bore. The second end of the TDBS body comprises at least one discharge lateral alignment lip. An O-ring lies in the O-ring groove.

Alternative embodiments of an improved valve stem guide and spring retainer assembly of the present invention comprise, in addition to a DVLSG-II or TDBS, an SVTSG-SR-II for placement substantially opposite the DVLSG-II or TDBS and within a correspondingly outwardly flared suction bore transition area of a plunger pump fluid end housing of the present invention. The SVTSG-SR-II comprises a body having a first end, a second end, a longitudinal axis, and at least one elongated cross-section that is perpendicular to the longitudinal axis. The SVTSG-SR-II body additionally comprises at least one peripheral O-ring groove, a centrally-located upper valve stem guide, and at least one longitudinal fluid passage extending between the first and second ends. For applications involving a suction valve without an upper valve stem, the upper valve stem guide may be eliminated from the SVTSG-SR-II, thus forming a suction valve spring retainer (SVSR). An O-ring lies in the O-ring groove, and the body of the SVTSG-SR-II (or SVSR) is outwardly flared longitudinally (i.e., the body has a fifth predetermined peripheral outward taper from the first end to the second end). The SVTSG-SR-II second end comprises at least one suction lateral alignment lip.

Alternative embodiments of valve stem guide and spring retainer assemblies of the present invention further comprise, in addition to either a DVLSG-II or a TDBS, plus an SVTSG- SR-II or an SVSR, integrated spacer and access bore cover. The spacer portion is utilized for spacing the DVLSG-II, alternately the TDBS, a predetermined distance apart from the SVTSG-SR-II. The spacer has first and second parallel edges for insertion along one discharge lateral alignment lip and an opposing suction lateral alignment lip. The first and second parallel edges are spaced apart sufficiently to assure that, upon insertion of at least one side spacer as described between a DVLSG-II (or TDBS) and an SVTSG-SR-II (or SVSR) in a corresponding plunger pump fluid end housing, the DVLSG-II (or TDBS) and the SVTSG-SR-II (or SVSR) will be self-centered. Further, the shoulder mating surface of the DVLSG-II (or TDBS) will contact a discharge bore shoulder to transmit the suction valve spring force from the SVTSG-SR-II (or SVSR) to the shoulder.

Simultaneous with this transmission of suction valve spring force, self-centering of the DVLSG-II (or the TDBS) and the SVTSG-SR-II (or SVSR) will occur. Such self-centering is facilitated by one or more O-rings in peripheral O-ring grooves. These O-rings and grooves are dimensioned to allow an increasingly close sliding fit as the DVLSG-II (or the TDBS) and the SVTSG-SR-II (or SVSR) are accommodated within their respective outwardly flared transition areas. Such accommodation is achieved when, for example, the first predetermined outward taper of the suction bore transition area is equal to or slightly greater than the fifth predetermined peripheral outward taper of the SVTSG-SR-II (or SVSR). Similarly, such accommodation is achieved when, for example, the second predetermined outward taper of the discharge bore transition area is equal to or slightly greater than the third predetermined peripheral outward taper of the DVLSG-SR or the fourth predetermined peripheral outward taper of the TDBS. As the O-rings contact the respective outwardly flared transition areas, further insertion is resisted due to increasing compression of the O-rings. Because such O-ring compression occurs substantially equally along each O-ring periphery, the resulting peripheral compressive forces tend to self-center the DVLSG-II (or the TDBS), as well as the SVTSG-SR-II (or SVSR) within their respective outwardly flared transition areas. Because of the resilience of the O-rings, this self-centering function is effective over a small range of longitudinal, lateral and angular movement within each outwardly flared transition area. Thus, the DVLSG-II (or the TDBS) and the SVTSG-SR-II (or SVSR) can move slightly to accommodate small misalignments of the discharge and suction valve bodies and/or small misalignments of valve guide stems (due, e.g., to manufacturing tolerances). Note also that each side spacer may be dimensioned to fit closely between the plunger pump fluid end housing and a plunger inserted for use within the housing. By decreasing the amount of internal pump space that is not swept by the plunger, such close fitting of each side spacer can improve a pump's volumetric efficiency.

Figure 5:
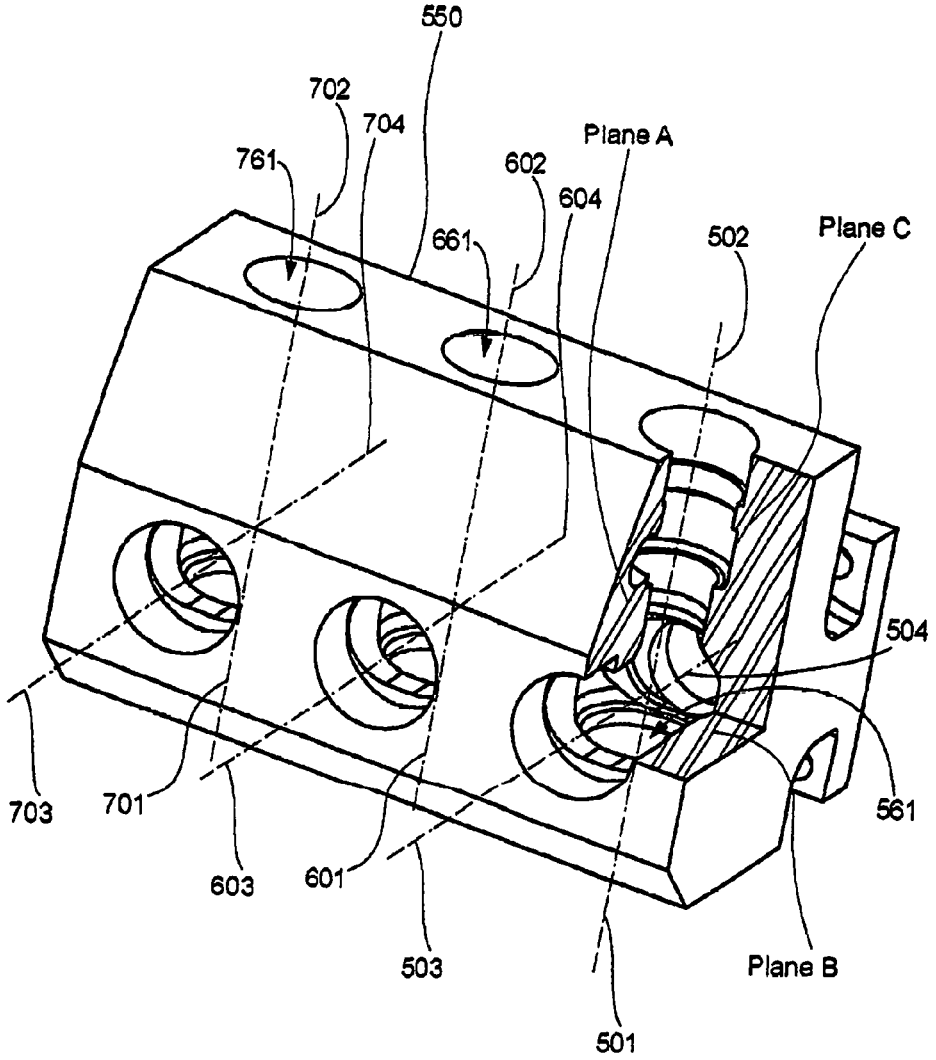
FIG. 5 schematically illustrates an orthogonal view of a plunger pump fluid end housing having access, suction, and discharge bores, offset from the plunger bore.

FIG. 5 is an orthogonal drawing of a fluid end housing 550 of the present invention. Triplex fluid end housing 550 illustrated in FIG. 5 contains three distinct fluid chambers 561, 661, and 761. FIG. 5 also illustrates three different cross sectionals of an outside fluid chamber 561 of fluid end housing 550. Each individual cross section being defining three distinct planes: A, B, and C as shown in FIG. 5. Each plane is perpendicular to each of the other planes.

FIG. 5 further illustrates plunger bore centerlines 504, 604, and 704 associated with fluid chambers 561, 661, and 761 respectfully. Plunger bore centerlines 504, 604, and 704 are collinear with cylinder centerlines in the power end of the pump not shown. Suction bore centerline 501, discharge bore centerline 502, and access bore centerlines 503 are offset from plunger bore centerline 504 in plane B; the direction of the offset is perpendicular to plane A towards the center of the fluid end housing 550. This offset is shown in greater detail in FIGS. 6B and 6C. Similarly suction bore centerline 701, discharge bore centerline 702, and access bore centerlines 703 are offset from plunger bore centerline 704 toward the center of the fluid end housing 550. Suction bore centerline 601, discharge bore centerline 602, and access bore centerline 603 are not offset from plunger bore centerline 604 and access bore centerline 603 is collinear with plunger bore centerline 604. In FIG. 5, Plane A is defined by suction bore centerline 501, discharge bore centerline 502, and access bore centerline 503. Plane B is defined by plunger bore centerlines 504, 604, and 704 and access bore centerlines 503, 603, and 703. Plane C is defined by discharge bore centerlines 502, 602, and 702 and suction bore centerlines 501, 601, and 701.

Figure 6A:
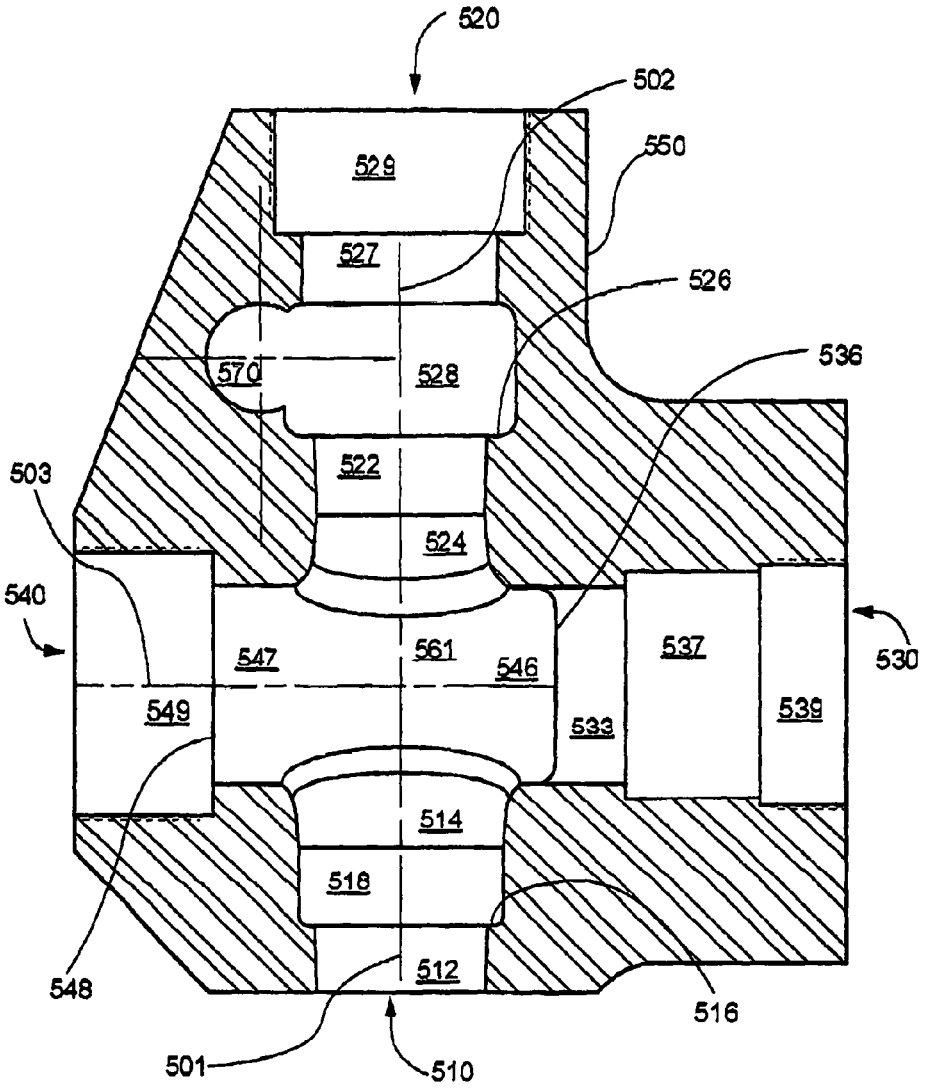
FIG. 6A schematically illustrates the sectional view labeled Plane A in FIG. 5; offset not visible in this figure.
Figure 6B:
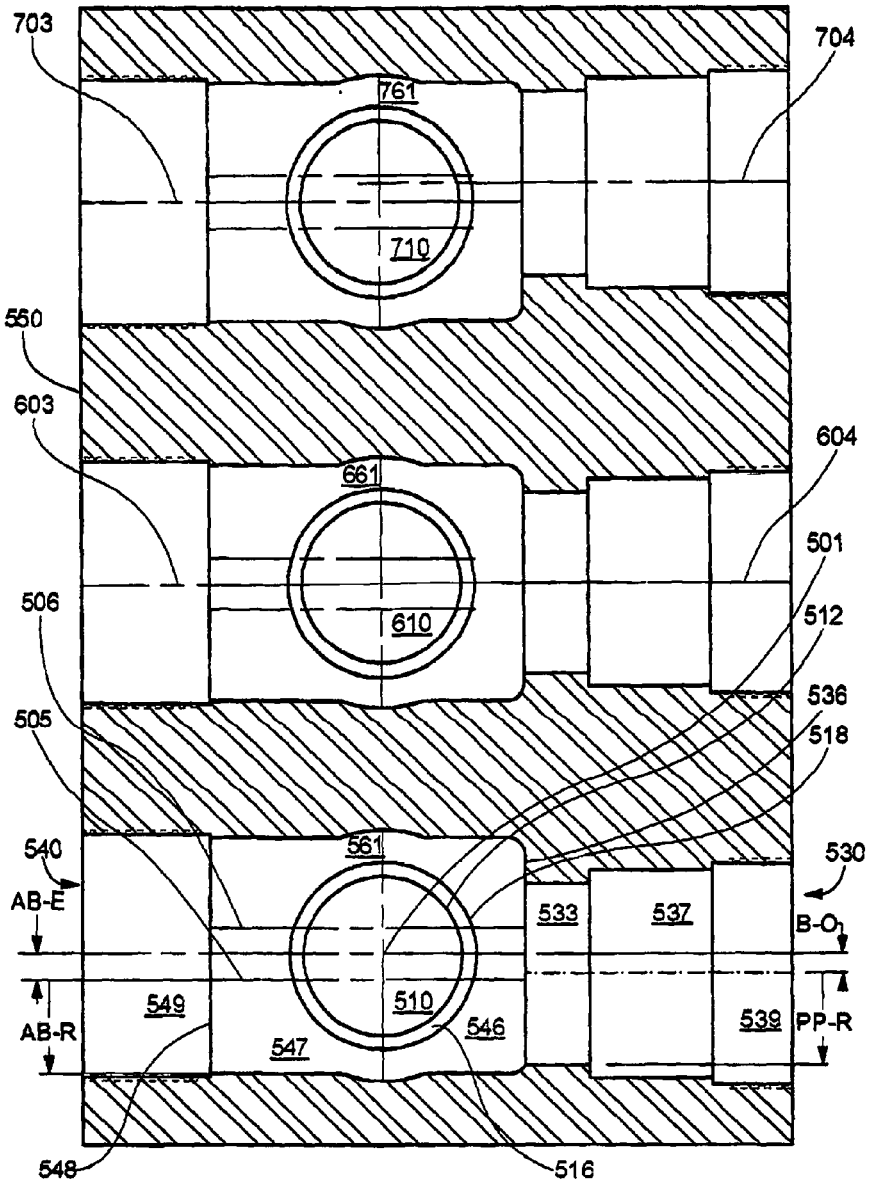
FIG. 6B schematically illustrates the sectional view labeled Plane B in FIG. 5; offset visible in this figure.
Figure 6C:
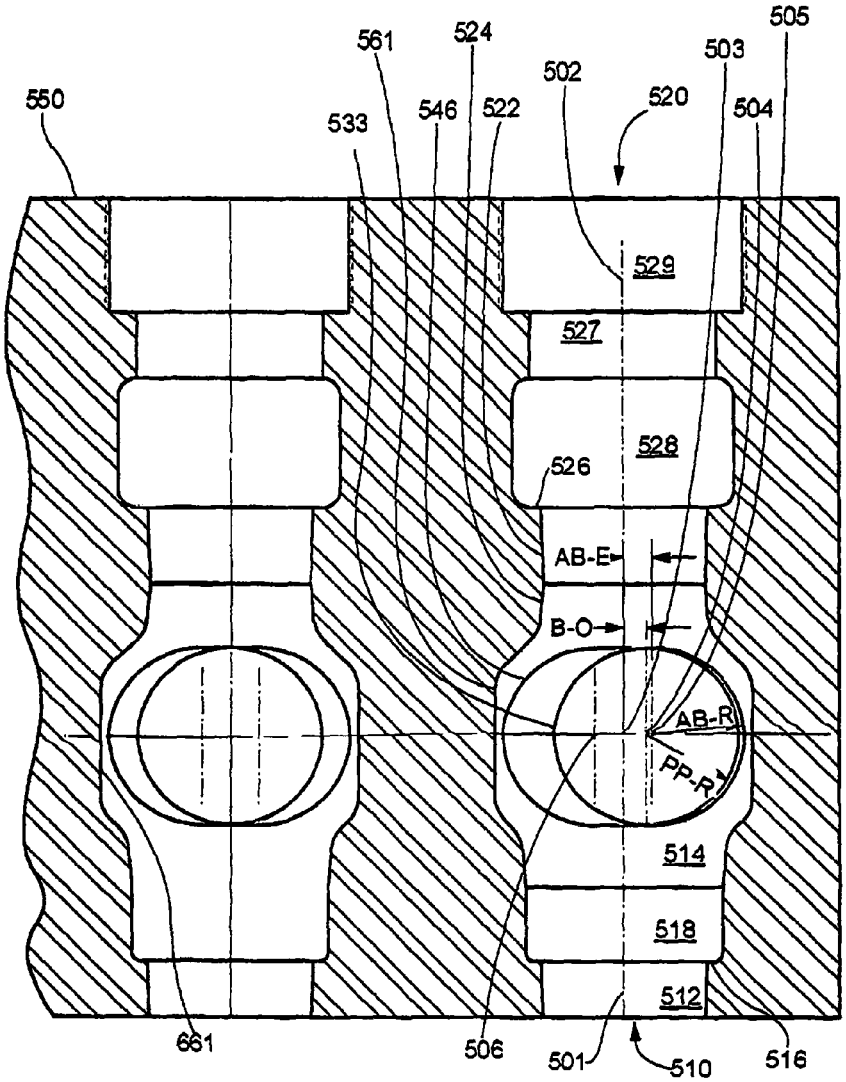
FIG. 6C schematically illustrates the sectional view labeled Plane C in FIG. 5; offset visible in this figure.

FIG. 6A further illustrates the sectional view defined by plane A as defined in FIG. 5. Illustrated in FIG. 6A is an outside fluid chamber 561 of a right-angular pump fluid end housing 550 of the present invention, including suction bore 510 having a first centerline 501 and comprising a suction seat taper portion 512 adjacent to a suction valve chamber 518. The suction valve chamber 518 of suction bore 510 is followed by an outwardly flared transition area 514. There is a suction bore shoulder 516 between seat taper portion 512 and a suction valve chamber 518.

Continuing with FIG. 6A, a discharge bore 520 with a second centerline 502, comprises a discharge seat taper portion 522, adjacent to a discharge valve chamber 528; a discharge bore shoulder 526 separates the seat taper portion 522 from the discharge valve chamber 528. The second 502 centerline being co-linear with the first centerline 501 of the suction bore. Discharge bore 520 also comprises an outwardly flared transition area 524, adjacent to seat taper 522. Above the discharge valve chamber 528, a discharge cover seal area 527 and discharge retainer area 529 complete the discharge bore 520. Discharge manifold 570 connects discharge valve chambers 528, 628, and 728.

Continuing with FIG. 6A, an access bore 540 with a third centerline 503 comprises an elongated cylindrical area 547, a cylindrical retainer area 549; a shoulder 548 between elongated area 547 and retainer area 549. The third centerline 503 is co-planar with the first centerline 501 and second centerline 502, forming plane A as shown in FIG. 5. Second elongated cylindrical area 546 is an extension of elongated cylindrical area 547, interrupted by fluid chamber 561. The principal of elongated cylindrical areas has been previously disclosed by applicant's previous patents: U.S. Pat. Nos. 8,894,392; 8,147,227; 7,513,759; 7,186,097; 6,910,871; 6,623,259; 6,544,012; 6,382,940.

Continuing with FIG. 6A, a plunger bore 530 with a fourth centerline 504 (not shown in this Figure), comprises a cylindrical packing area 537 having, a cylindrical plunger passage area 533, a cylindrical retainer area 539, and a plunger bore shoulder 536 between plunger passage bore 533 and elongated area 546. The fourth centerline 504 is displaced from plane A, as such the fourth centerline 504 is not visible in FIG. 6A, being out of the plane A. The relationship of the fourth centerline 504 with plane A and centerlines 501, 502, and 503 is best viewed in FIG. 6B.

FIG. 6B further illustrates a sectional view defined in FIG. 5 by plane B, of a right-angular pump fluid end housing 550 of the present invention. Outside fluid chamber 561 of the fluid end housing 550 comprises a suction bore 510 with a suction seat taper 512, the adjacent suction valve chamber 518, and the shoulder 516 between seat taper portion 512 and a suction valve chamber 518. First centerline 501 is seen on end as an infinitely small dot at the center of suction seat taper 512 and suction valve chamber 518. Also illustrated in FIG. 6B is access bore 540 with a third center line 503 comprises an elongated cylindrical areas 547, 546, and a cylindrical retainer area 549; a shoulder 548 between elongated area 547 and retainer area 549. The third centerline 503 is co-planar with the first centerline 501 and second centerline 502, forming plane A as shown in FIG. 5. Second elongated cylindrical area 546 is an extension of elongated cylindrical area 547, interrupted by fluid chamber 561.

Continuing with FIG. 6B, a plunger bore 530 with a fourth centerline 504, comprises a cylindrical packing area 537, a cylindrical plunger passage area 533, a cylindrical retainer area 539, and a plunger bore shoulder 536 between plunger passage bore 533 and elongated area 546. Centerlines 503, 504, 603, 604, 703, and 704 are coplanar in plane B. The first centerline 501, second centerline 502, and third centerline 503 and their respective bores 510, 512, 514, 518, 522, 524, 528, 527, and 529 are displaced from centerline 504 toward the center of fluid end housing 550. Similarly centerlines 701, 702, and 703 and their respective bores 710, 712, 714, 718, 722, 724, 728, 727, and 729 are displaced from centerline 704 in the opposite direction toward the center of fluid end housing 550.

Continuing with FIG. 6B, elongated cylindrical areas 547 and 546 have fifth and sixth centerlines 505 and 506 respectfully for each elongated cylindrical section which are also illustrated in FIG. 6C. Fifth and sixth centerlines 505 and 506 are also coplanar with centerlines 503, 504, 603, 604, 605, 606, 703, 704, 705, and 706 in plane B.

As illustrated in FIG. 6B, AB-E denotes the Access Bore-Elongation the distance between the access bore centerline 503 and the elongated cylindrical section centerline 505. B-O denotes the Bore-Offset of the access bore 540, suction bore 510, and discharge bore 520 away from the plunger bore 530 or the distance between the access bore centerline 503 and plunger bore centerline 504. AB-R denotes the Access Bore-Radius of the cylindrical section of the elongated access bore; PP-R indicates the Plunger Passage (bore)-Radius. There is a limit to the amount of the Bore-Offset B-O, this limit is expressed mathematically:

$$B\text{-}O <= AB\text{-}E + (AB\text{-}R - PP\text{-}R.)$$

FIG. 6C further illustrates a sectional view defined in FIG. 5 by plane C, of a right-angular pump fluid end housing 550 of the present invention. To keep FIGS. 6A, 6B, and 6C all in the same scale, FIG. 6C only shows fluid chambers 561 and 661 of housing 550. Chamber 561 includes a suction bore 510 having a first centerline 501 and comprising a suction seat taper portion 512 adjacent to a suction valve chamber 518. The suction valve chamber 518 of suction bore 510 is followed by an outwardly flared transition area 514. There is a suction bore shoulder 516 between seat taper portion 512 and a suction valve chamber 518.

Continuing with FIG. 6C, a discharge bore 520 with a second centerline 502, comprises a discharge seat taper portion 522, adjacent to a discharge valve chamber 528; a discharge bore shoulder 526 separates the seat taper portion 522 from the discharge valve chamber 528. The second 502 centerline being co-linear with the first centerline 501 of the suction bore. Discharge bore 520 also comprises an outwardly flared transition area 524, adjacent to seat taper 522. Above the discharge valve chamber 528, a discharge cover seal area 527 and discharge retainer area 529 complete the discharge bore 520. Centerlines 503, 504, 505, and 506 are seen on end in FIG. 6C and shown as infinitely small dots at the center of elongated access bore 546, plunger passage bore 533, right hemi-cylindrical section of elongated access bore 546, and left hemi-cylindrical section of elongated access bore 546 respectfully.

FIG. 6C again illustrates the relationship between the Access Bore-Elongation AB-E, the Bore-Offset B-O, the Access Bore-Radius AB-R, and the Plunger Passage-Radius PP-R. There is a limit to the amount of the Bore-Offset B-O, this limit is expressed mathematically:

$$B\text{-}O <= AB\text{-}E + (AB\text{-}R - PP\text{-}R.)$$

As shown in FIG. 6C in the central fluid chamber 661 there is no offset of the access bore 640, discharge bore 620, suction bore 610, or the access bore centerline 603. The elongated hemi-cylindrical sections of the access bore 646 are offset from the access bore centerline 603 which is co-linear with the plunger bore centerline 604. Access bore centerline 603 and plunger bore centerline 604 are seen on end as infinitely small dots at the center of plunger passage bore 633. Not shown, the fluid chamber 761 is equally offset opposite to the offset of 561 toward the central fluid chamber 661.

Figure 8B:
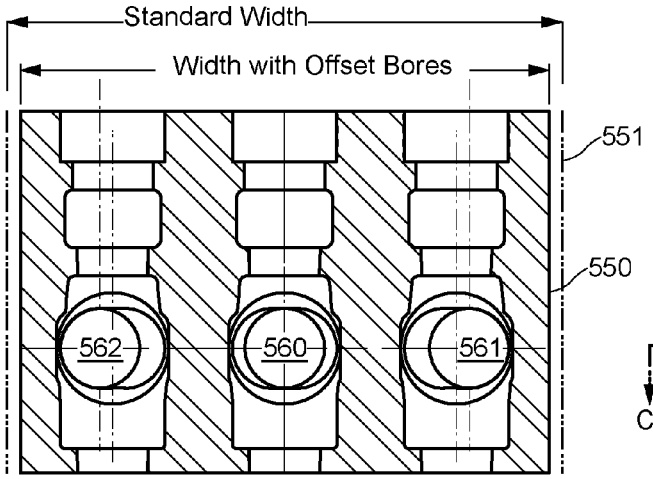
FIG. 8B schematically illustrates the top view of a right-angular plunger pump fluid end housing having opposing offset access, suction, and discharge bores.
Figure 8A:
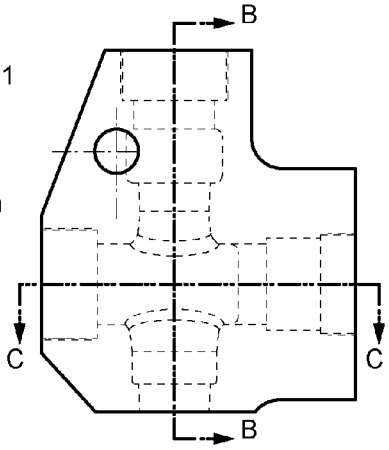
FIG. 8A schematically illustrates the end or edge view of a right-angular plunger pump fluid end housing having opposing offset access, suction, and discharge bores; offset not visible in this figure.
Figure 8C:
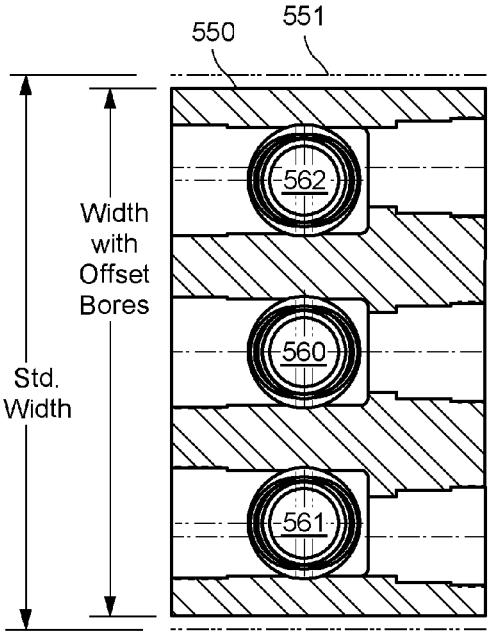
FIG. 8C schematically illustrates the frontal view of a right-angular plunger pump fluid end housing having opposing offset access, suction, and discharge bores.
Figure 9A:
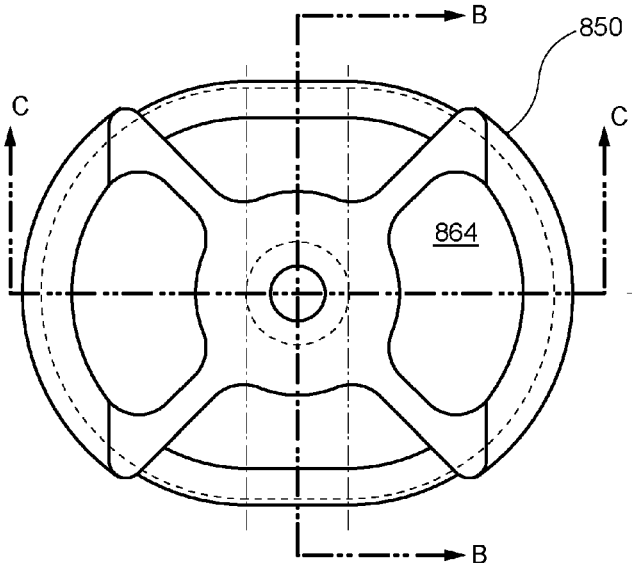
FIG. 9A schematically illustrates a top view of an SVTSG-SR-II.
Figure 9B:
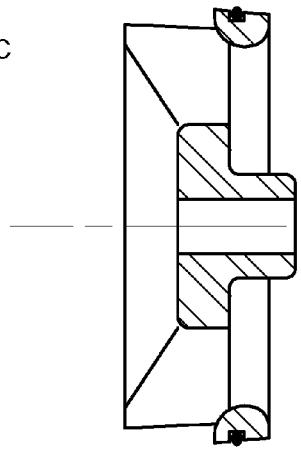
FIG. 9B schematically illustrates the sectional view labeled B-B in FIG. 9A.
Figure 9C:
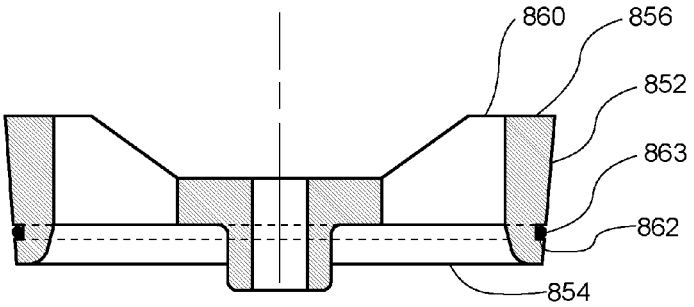
FIG. 9C schematically illustrates the sectional view labeled C-C in FIG. 9A.
Figure 10A:
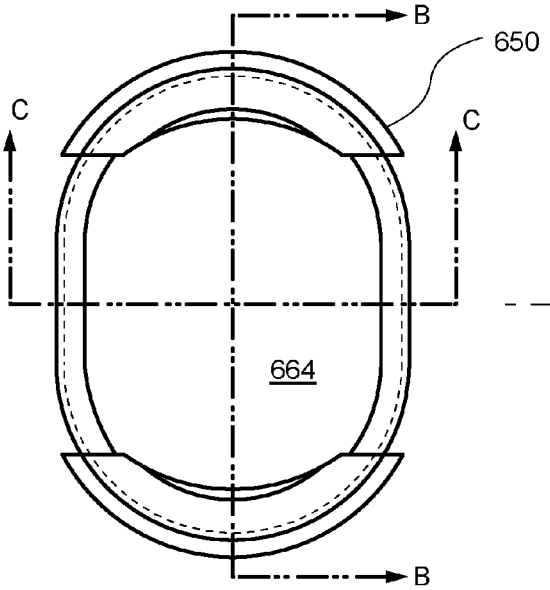
FIG. 10A schematically illustrates a top view of a TDBS.
Figure 10B:
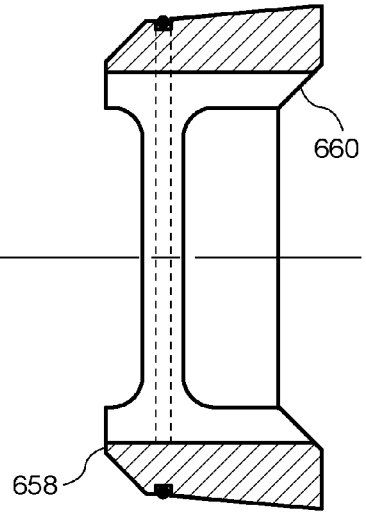
FIG. 10B schematically illustrates the sectional view labeled B-B in FIG. 10A.
Figure 10C:
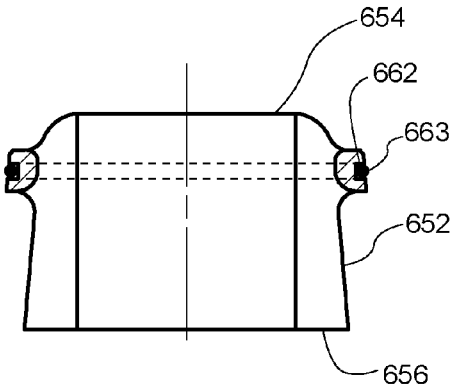
FIG. 10C schematically illustrates the sectional view labeled C-C in FIG. 10A.
Figure 10D:
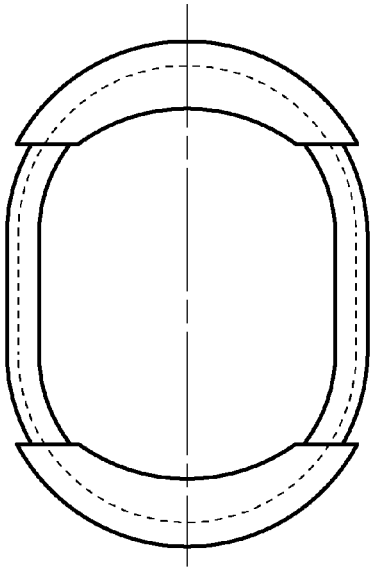
FIG. 10D schematically illustrates a bottom view of a TDBS.
Figure 11C:
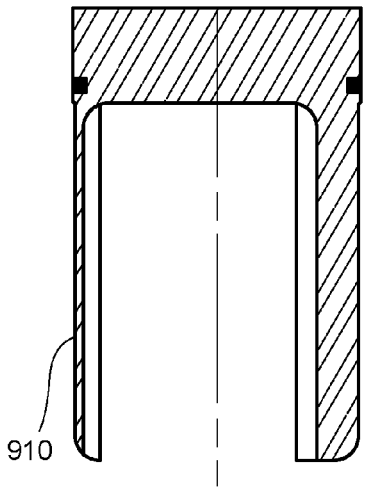
FIG. 11A schematically illustrates an end view of the access bore plug and integral spacers.
FIG. 11B schematically illustrates the sectional view labeled B-B in FIG. 11A FIG. 11C schematically illustrates the sectional view labeled C-C in FIG. 11A.
Figure 11B:
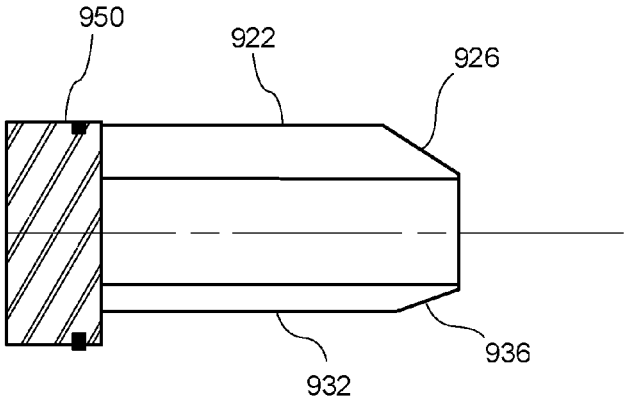
Figure 11A:
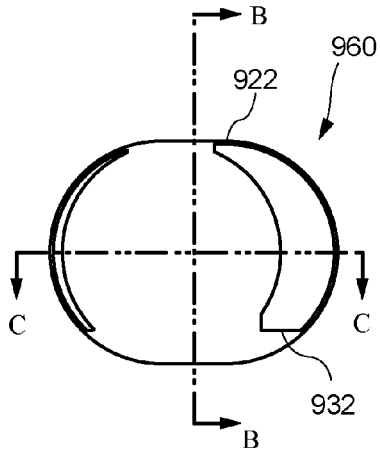

Three views, FIGS. 8A, 8B, and 8C schematically illustrate the overall dimensions of the fluid end that utilize offset opposing suction, discharge, and access bores of the outside fluid chambers to reduce the overall width and weight of the fluid end housing 550. Dashed lines schematically illustrate the location of the internal bores. Heavy broken lines 551 on each end of the fluid end housing 550 indicate the amount of weight reduction of the entire fluid end housing with this invention. Note that the suction, discharge, and access bores of the center fluid chamber 661 are not offset in this illustration. In FIGS. 8B and 8C fluid chambers 561, 661, and 761 are illustrated. The offsets of the access, suction, and discharge bores in fluid chambers 561 and 761 are opposite and opposing towards the center of the fluid end housing 550.

Figure 7A:
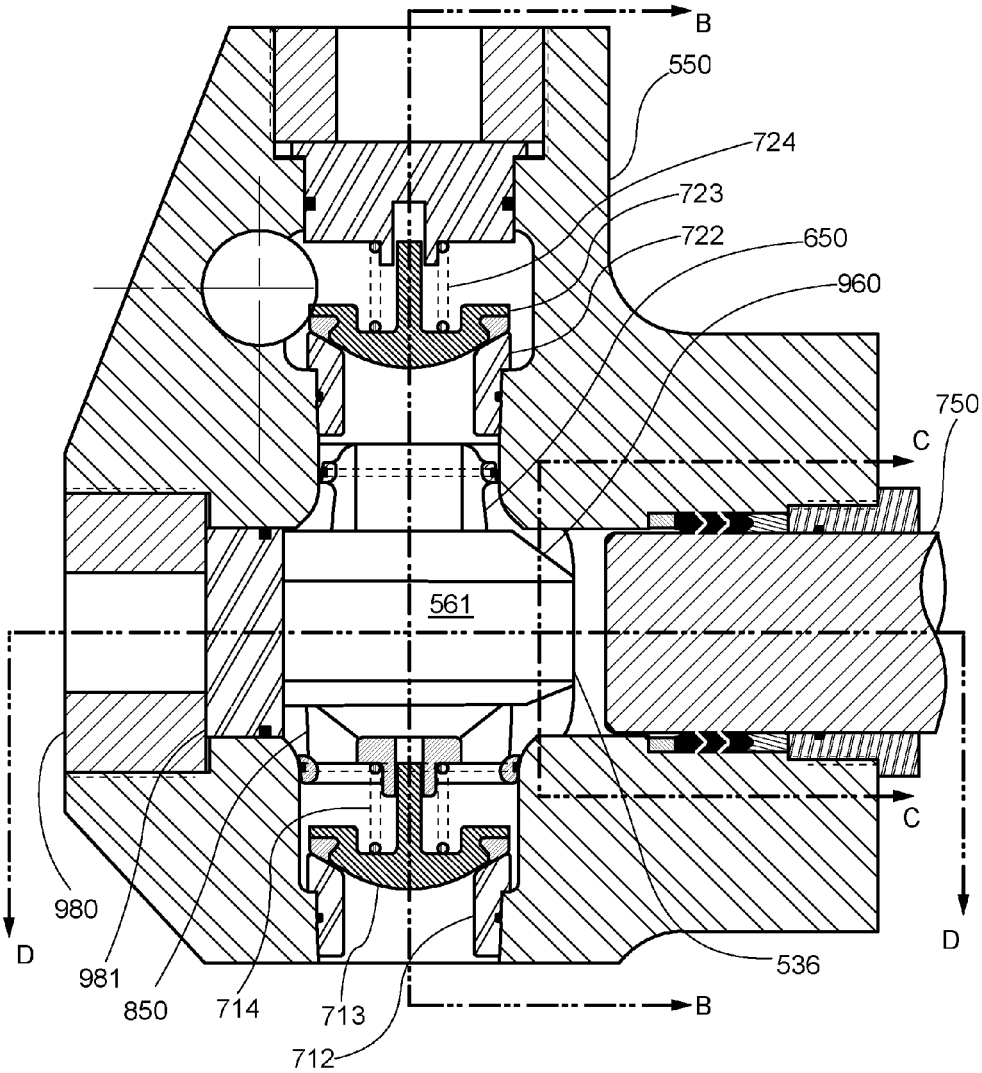
FIG. 7A schematically illustrates a cross-section of a right-angular plunger pump fluid end assembly having opposing offset access, suction, and discharge bores; offset not visible in this figure. A top stem guided suction valve, a top stem guided discharge valve, and a flangeless access bore plug is also shown; offset not visible in this figure.

FIG. 7A schematically illustrates a cross-section of an outside fluid chamber 561 of a right-angular pump fluid end assembly of the present invention, including fluid end housing 550, fluid chamber 561, plunger 750, suction valve 713, suction seat 712, suction valve spring 714, discharge valve 723, discharge seat 722, and discharge valve spring 724.

Figure 7B:
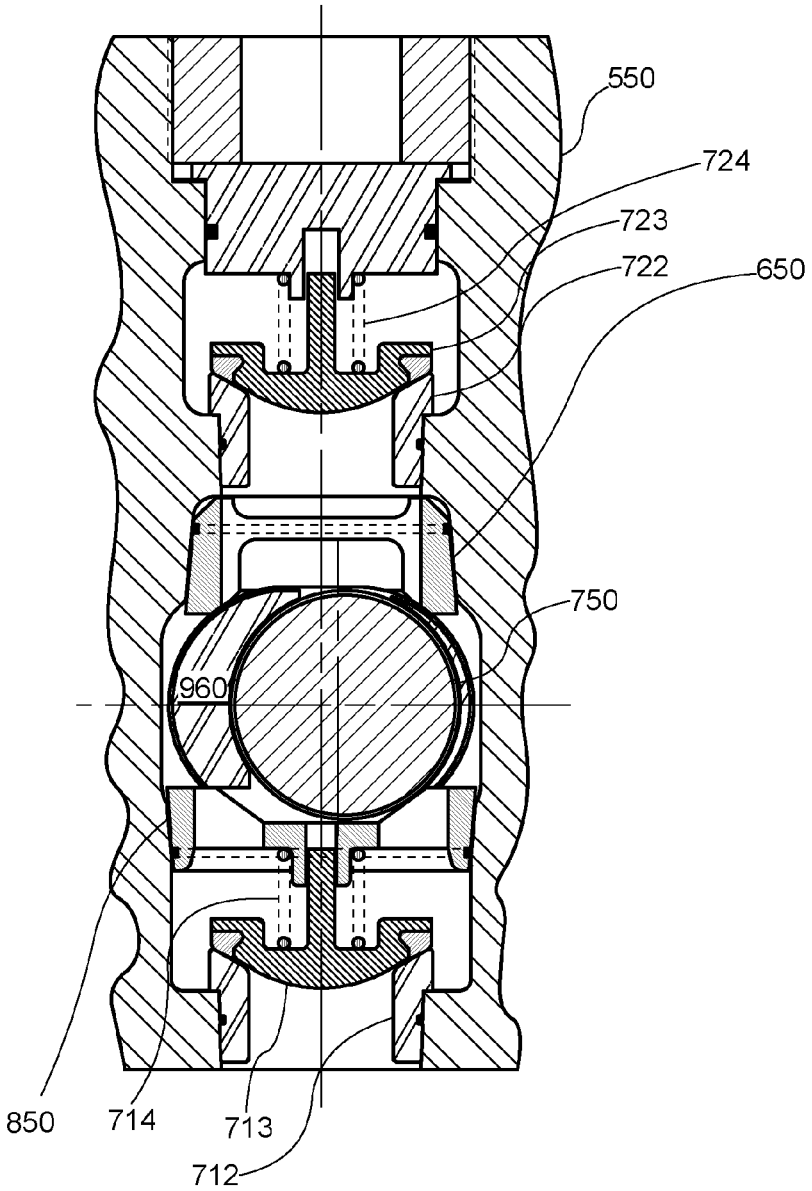
FIG. 7B schematically illustrates the sectional view labeled B-B in FIG. 7A; offset visible in this figure.
Figure 7C:
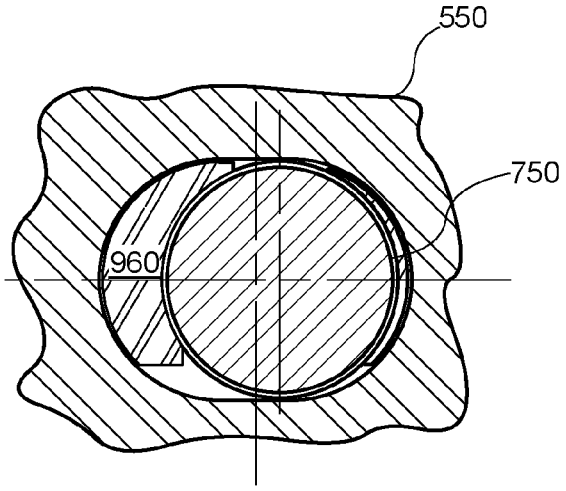
FIG. 7C schematically illustrates the sectional view labeled C-C in FIG. 7A; offset visible in this figure.

An embodiment of a valve stem guide and spring retainer assembly within a pump housing 550 is schematically illustrated in FIGS. 7A-C. Components of the assembly are shown in greater detail in FIGS. 9A-C, 10A-D, and 11A-C. The assembly comprises a tapered discharge bore spacer 650 (see FIGS. 10A-D) which itself comprises a body 652 having a first end 654, a second end 656, a longitudinal axis, and at least one elongated cross-section perpendicular to the longitudinal axis. First end 654 comprises a shoulder mating surface 658, and second end 656 comprises at least one beveled internal alignment shoulder 660. Body 652 is outwardly flared longitudinally and additionally comprises at least one peripheral O-ring groove 662, and at least one longitudinal fluid passage 664 extending between first end 654 and second end 656. An O-ring 663 lies in O-ring groove 662.

The embodiment of a valve stem guide and spring retainer assembly within a pump fluid end housing 550 as schematically illustrated in FIGS. 7A-C further comprises a tapered suction valve top stem guide and spring retainer 850 (see FIGS. 9A-C) comprising a body 852 having a first end 854, a second end 856, a longitudinal axis, and at least one elongated cross-section perpendicular to the longitudinal axis. Body 852 is outwardly flared longitudinally and additionally comprises at least one peripheral O-ring groove 862. At least one longitudinal fluid passage 864 extends between first end 854 and second end 856. An O-ring 863 lies in O-ring groove 862.

The embodiment of a valve stem guide and spring retainer assembly within a pump fluid end housing 550 as schematically illustrated in FIGS. 7A-C further comprises a side spacer-plug 960 (see FIGS. 11A-C) comprising a access bore plug 950 integral with at least one side spacer 910, a longitudinal axis, and at least one elongated cross-section perpendicular to the longitudinal axis. Spacer or spacers having first and second parallel edges 922 and 932 respectively for insertion above the valve stem guide and spring retainer 850. Longitudinal movement of each side spacer 910 is limited by flangeless access bore plug 960 and access bore 544 and the plunger bore transition area 534.

Figure 7D:
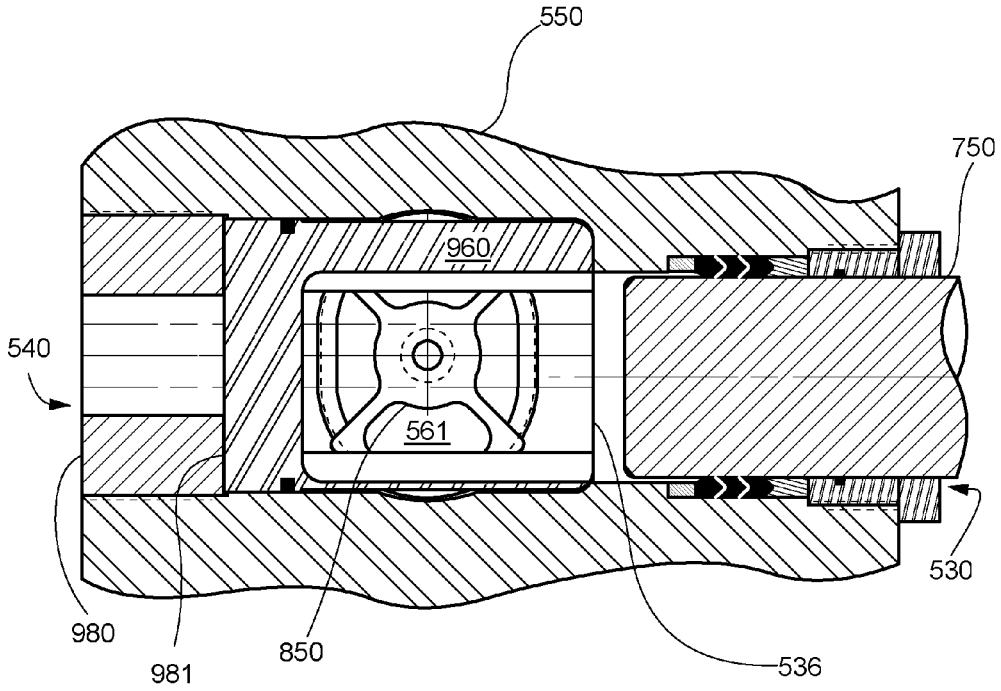
FIG. 7D schematically illustrates the sectional view labeled D-D in FIG. 7A; offset visible in this figure.

Axial movement of the side spacer-plug 960 (see FIGS. 11A-C) is limited by the threaded plug retainer 980 and the plunger bore shoulder 536 as shown in FIGS. 7A and 7D. Tightening threaded plug retainer 980 to it maximum insertion limit into the retainer area 542, clamps the side spacer-plug 960 between the face 981 of the threaded plug retainer 980 and the plunger bore shoulder 536.

During assembly of a plunger pump incorporating the side spacer-plug 960, each insertion ramp 936, for edge 922 and ramp 926 for edge 922, make contact with the top of the valve stem guide and spring retainer 850 and the bottom of the tapered discharge bore spacer 650 respectfully. Due to the relatively acute angle (i.e., less than about 45 degrees) that insertion ramp 936 makes with the parallel edge 932, each insertion ramp 936 confers the mechanical advantage of an inclined plane in moving a tapered suction valve top stem guide and spring retainer 850 into the respective suction bore. Similarly, the angle that insertion ramp 926 makes with the parallel edge 922, each insertion ramp 926 confers the mechanical advantage of an inclined plane in moving tapered discharge bore spacer 650 into the respective discharge bore.

Although the present invention has been described in detail, it should be understood that various changes, substitutions and alterations can be made hereto without departing from the spirit and scope of the invention as defined by the appended claims.

What is claimed:

1. A plunger pump fluid end housing with multiple fluid chambers arranged in a longitudinal plane, each fluid chamber comprising:

an access bore;

a discharge bore;

a suction bore;

a plunger bore;

wherein a first plunger bore of a first fluid chamber is disposed on a first axis corresponding to a first centerline plunger axis of said housing;

a second plunger bore of a second fluid chamber is disposed on a second axis corresponding to a second centerline plunger axis parallel to said first centerline plunger axis and spaced from said first axis by a first predetermined distance thereby defining the second plunger bore spacing; and a third plunger bore of a third fluid chamber is disposed on a third axis corresponding to a third centerline plunger axis of said housing, said third axis being parallel to said first axis and spaced from said first axis by a second predetermined distance thereby defining the third plunger bore spacing;

wherein said longitudinal plane is defined by the first, second, and third axes of the plunger bores of the multiple fluid chambers;

wherein each of said respective first, second and third access bores, comprise elongated cylindrical sections and wherein said elongated sections are elongated in a direction perpendicular to a plane formed by the axes of said respective first, second and third access bores, discharge bores, and suction bores;

wherein the respective access bores, discharge bores, and suction bores of said second and third fluid chambers are each are offset longitudinally away from the respective plunger bore in a direction perpendicular to a plane formed by the axes of said access bore, discharge bore, and suction bore;

wherein said offset of said respective discharge, suction, and access bores of said second and third fluid chambers are offset in a direction away from the outside boundaries of said fluid end housing, and wherein the respective offsets of the discharge, suction, and access bores of said second and third fluid chambers are opposite.

2. The fluid end housing of claim 1, wherein the respective offsets of the discharge, suction, and access bores of said second and third fluid chambers are equal and opposite.

3. The fluid end housing of claim 1, wherein the respective axes of said access bore, discharge bore, and suction bore of the central fluid chambers are not offset with respect to the axis of said plunger bore.

4. The fluid end housing of claim 1, wherein said plunger bore extends into said elongated cylindrical section of said access bore at a shoulder separating the respective bores.

5. The fluid end housing of claim 1, wherein the overall width of the fluid end is reduced by the amount of offset of the access bore, discharge bore, and suction bores in each of the outside fluid chambers.

6. The fluid end housing of claim 1, wherein the suction and discharge bores comprise cylindrical and tapered sections.

* * * * *